US006212902B1

(12) United States Patent
Leistner

(10) Patent No.: US 6,212,902 B1
(45) Date of Patent: Apr. 10, 2001

(54) GAS ABSORPTION COOLING SYSTEM

(75) Inventor: David W. Leistner, Sidney, OH (US)

(73) Assignee: Norcold, Inc., Sidney, OH (US)

( * ) Notice: Subject to any disclaimer, the term of this patent is extended or adjusted under 35 U.S.C. 154(b) by 0 days.

(21) Appl. No.: 09/416,068

(22) Filed: Oct. 12, 1999

Related U.S. Application Data

(60) Provisional application No. 60/108,071, filed on Nov. 12, 1998.

(51) Int. Cl.[7] ..... F25B 33/00

(52) U.S. Cl. ..... 62/497; 62/238.3; 62/476

(58) Field of Search ..... 62/238.3, 476, 62/497

(56) References Cited

U.S. PATENT DOCUMENTS 4,538,424 * 9/1985 Meyers ..... 62/236
4,548,048 * 10/1985 Reimann et al. ..... 62/238.3
4,890,463 * 1/1990 Cantoni ..... 62/238.3
5,355,693 * 10/1994 McConnell et al. ..... 62/2.44
5,381,674 * 1/1995 Omori et al. ..... 62/497
5,383,341 * 1/1995 Zur et al. ..... 62/476
5,946,929 * 9/1999 Selina et al. ..... 62/263
6,009,721 * 1/2000 Fukuda et al. ..... 62/476

* cited by examiner

*Primary Examiner*—William Doerrler
*Assistant Examiner*—Mark S. Shulman
(74) *Attorney, Agent, or Firm*—Harness, Dickey & Pierce P.L.C.

(57) ABSTRACT

A gas absorption refrigeration apparatus combines two or more separate gas absorption cooling systems. Each cooling system consists of a generator, a condenser, an evaporator, an absorber and tubing connecting the parts to form a complete circulation system for a refrigerant, an absorption liquid and an inert gas. The cooling systems are mounted to a common cabinet with the evaporators of each system being located within the interior insulated compartment of the cabinet. The generator of each cooling system shares a common heat source.

14 Claims, 1 Drawing Sheet

GAS ABSORPTION COOLING SYSTEM

This application claims benefit of Provisional application No. 60/108,071 filed Nov. 12, 1998.

BACKGROUND OF THE INVENTION

This invention relates generally to a gas absorption refrigerator, such as typically equips a recreational vehicle (RV), boat or a trailer home. More particularly, the invention relates to a gas absorption refrigerator with increased cooling power compared with a conventional RV refrigerator without extending the refrigerator cabinet in an upward direction. This cooperative arrangement of vehicle space and refrigerator components enables the refrigerator cold compartment to be enlarged in a horizontal direction.

Recreational vehicles are commonly equipped with refrigerators for cooling and preserving food and drinks. Such refrigerators are usually conventional gas absorption-type refrigerators which use a heat source to effect refrigeration. Absorption refrigerators are favored in vehicles such as recreational vehicles because a compressor is not required and the heat generator can be either an electrical resistance heater or a gas heater and allow selection between the heat sources. The gas heater can be fueled by propane gas which is usually carried on a recreational vehicle.

In an absorption refrigerator the heat generator heats a solution of a refrigerant and an absorbent. Heating the solution releases a portion of the refrigerant from the solution in the form of a vapor. The refrigerant vapor is condensed in a cooling condenser. The refrigerant is boiled in the evaporator, which removes heat from the insulated compartment. The refrigerant vapor is combined back into the solution in the absorber and the combined solution is directed back to the generator.

It is well known in the art that absorption refrigeration units without special provisions cannot function when significantly inclined from the vertical, typically above 3°, due to the units' dependence on gravity and buoyancy to cause the circulation of working fluids in the required thermodynamic cycles. This is a particular problem for RV and other mobile refrigerators as the vehicle may not be level when in transit or parked. It is taught in U.S. Pat. Nos. 3,775,996; 3,802,219; 3,851,497 and 4,458,504 that it is desirable to incline the condenser, evaporator and absorber at significantly higher angles, between 10° and 20°, to allow function of the refrigerator at higher angles of inclination. This solution has a particular disadvantage, however, because the vertical positioning of the components of the system is critical and long straight sections of piping angled across the width of the refrigerator may cause a given component to consume too much of the available cabinet height to allow proper vertical positioning of other components. The problem is especially acute when the available vertical height for the cabinet is restricted, even to the point of not allowing the normal angle of piping inclination in a short cabinet. The aforementioned patents teach solutions to this problem by specially configuring the condenser and absorber with shorter angled runs of piping in complex chevron shaped arrangements.

A gas absorption refrigerator of limited cabinet height has the additional problem that the height of the generator is restricted since it must, by necessity, be located vertically on the cabinet below the condenser. For a given heat input, the liquid and gas pressures created by the generator are partially determined by the height of the generator column. If the overall length of the condenser, evaporator or absorber is disproportionately long relative to the height of the generator or if the fluid flow path is unduly convoluted or restricted, the fluid flow is insufficient for efficient heat transfer and the cooling power of the refrigerator is reduced.

SUMMARY OF THE INVENTION

Accordingly, this invention provides for the combination of two gas absorption cooling units in a manner which overcomes the problems and disadvantages of the conventional techniques in the art. Briefly, the invention includes a unique configuration of a plurality of gas absorption cooling systems which are fastened, attached or connected so as to share a common cabinet, heat source, generator housing and controls. The combination of two gas absorption cooling units results in a system which provides additional cooling power than is otherwise achievable in the same vertical space occupied by the refrigerator. Each individual cooling system regains the desirable aspect ratio by being taller than it is wide. This enables RV builders to construct refrigerator configurations within the living space in the RV that would have been impossible prior to this invention due to height limitations on the cooling systems.

Further objects, features and advantages of the invention will become apparent from a consideration of the following description when taken in connection with the accompanying drawing.

BRIEF DESCRIPTION OF THE DRAWING

Further features and advantages of the invention will become apparent from the discussion and accompanying drawing, in which.

DETAILED DESCRIPTION OF THE PREFERRED EMBODIMENT

Figure 1:
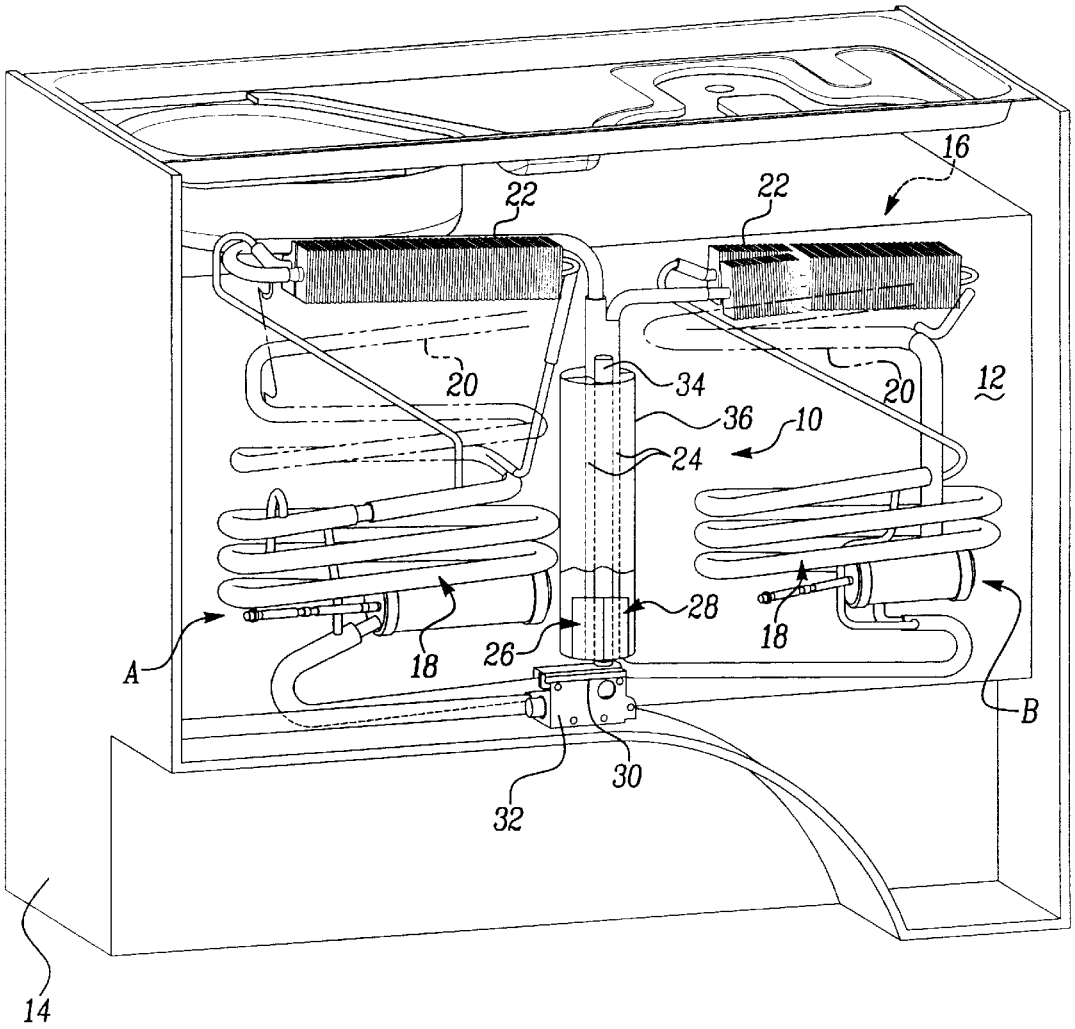
FIG. 1 is a perspective view of an RV refrigerator cabinet showing the gas absorption cooling system of this invention mounted on the rear side of the cabinet.

The following description of the preferred embodiment is merely exemplary in nature, and is in no way intended to limit the invention or its application or uses.

The cooling apparatus 10 of this invention is shown in FIG. 1 mounted on the back wall 12 of a refrigerator cabinet 14 which encloses an insulated compartment 16. The cooling apparatus 10 consists of two systems, A and B, each consisting of conventional gas absorption cooling components, namely an absorber 18, an evaporator 20, a condenser 22, and a generator 24. The systems A and B share a DC electrical heater 26, an AC electrical heater 28, a gas burner 30 and a single burner and control box 32 with a single gas flue 34. The generators 24, heaters 26 and 28, and the upper portion of the flue 34 are contained within a generator enclosure 36.

Presently, each gas absorption cooling system requires a set of controls to monitor the internal refrigerator temperature and control the heat to its generator area in this manner. This invention provides a combination of gas absorption cooling systems which allows a second gas absorption cooling system's generator to be heated in conjunction with another gas absorption system's generator using a single set of controls. The two gas absorption cooling systems (system "A" and system "B") are joined in the generator area in such a way that a single gas burner and/or a electrical heater unit can provide heat to both generators. The combination of the two gas absorption cooling units results in a system which provides additional cooling power than is otherwise achievable in a limited vertical space because the height of the generator, and consequently the system fluid flow, is matched to the length of the condenser, generator and evaporator. Additionally, because the desired height to width ratio of each system is increased, the generally horizontal piping runs may be made at higher angles to allow satisfactory tolerance of vehicle inclination.

This invention enables the possibility for providing gas absorption cooling to refrigerator configurations which otherwise would be unable to efficiently use gas absorption cooling due to height limitations The use of a common heat source, controls and generator box to power a plurality of absorption systems eliminates duplication of components. By applying heat energy to one absorption system generator, a plurality of absorption systems receives sufficient heat energy and fluid flow to function as intended. The arrangement of components in this invention provides additional absorption refrigeration performance in an application where height of the appliance is limited, and still accommodates off-level operation. Additionally, the use of two cooling systems allows cooling at a reduced level if one system should fail. The invention is easily manufactured using conventionally configured gas absorption refrigeration components.

The foregoing discussion discloses and describes a preferred embodiment of the invention. One skilled in the art will recognize from such discussion, and from the accompanying drawing and claims, that changes and modifications can be made to the invention without departing from the true spirit and fair scope of the invention as described in the following claims.

What is claimed is:

1. A gas absorption refrigeration apparatus comprising:

a. a plurality of separate gas absorption cooling systems consisting of a generator, a condenser, an evaporator, an absorber and tubing connecting the aforesaid parts to form a complete circulation system for a refrigerant, an absorption liquid and an inert gas;

b. said gas absorption cooling systems being mounted to a common cabinet, said evaporators of each said system being located within a common thermally insulated compartment within said cabinet; and c. the generator of each said system sharing a common heat source.

2. The apparatus according to claim 1 wherein said gas absorption cooling systems are disposed alongside one another on a common wall of the cabinet.

3. The apparatus of claim 1 wherein said heat source consists of a gas burner and an electrical resistance heater unit.

4. The apparatus of claim 3 wherein said electrical resistance heater unit consists of an alternating current electrical resistance heater, and a direct current resistance heater.

5. The apparatus according to claim 3 wherein a single control unit selects and controls the type of heat provided by said heat source.

6. The apparatus according to claim 5 further including said control unit integral with a burner box with a single gas burner and flue.

7. The apparatus according to claim 1 where the generators and heat source are housed within a common generator enclosure.

8. A method for combining a plurality of gas absorption cooling systems to a common cabinet comprising the steps of:

a. providing a plurality of separate gas absorption cooling systems consisting of a generator, a condenser, an evaporator, an absorber and tubing connecting the aforesaid parts to form a complete circulation system for a refrigerant, an absorption liquid and an inert gas;

b. providing a cabinet having at least one wall;

c. mounting said gas absorption cooling systems to the cabinet;

d. providing a heat source;

e. locating said generators and said heat source in close proximity such that said generators share said heat source;

f. providing a thermally insulated compartment within said cabinet; and g. locating said evaporators commonly within said thermally insulated compartment.

9. The method of claim 8 including the further step of mounting said gas absorption cooling systems on a common wall of the cabinet.

10. The method of claim 8 wherein said heat source consists of a gas burner and an electrical resistance heater unit.

11. The method of claim 8 including the further steps of providing an alternating current electrical resistance heater and a direct current electrical resistance heater and combining said alternating current electrical resistance heater, and said direct current electrical resistance heater in said electrical resistance heater unit.

12. The method of claim 10 including the further steps of providing a single control unit capable of selecting and controlling the type of heat provided by said heat source, installing said control unit on said cabinet and establishing electrical or mechanical control connections to said heat source.

13. The method of claim 12 including the further steps of providing a burner box with a single gas burner, flue and an integral control unit and installing said burner box on said cabinet.

14. The method of claim 8 including the further steps of providing a single generator enclosure, installing said generator enclosure on said cabinet and housing said generators and heat source within said generator enclosure.

* * * * *